US007003808B2

(12) United States Patent
Seelye et al.

(10) Patent No.: US 7,003,808 B2
(45) Date of Patent: Feb. 28, 2006

(54) MOLDED FIBROUS PULP HAT

(75) Inventors: Scott S. Seelye, Corvallis, OR (US); Richard B. Hurley, Corvallis, OR (US); Mark W. Betts, Corvallis, OR (US)

(73) Assignee: Western Pulp Products Company, Corvallis, OR (US)

( * ) Notice: Subject to any disclaimer, the term of this patent is extended or adjusted under 35 U.S.C. 154(b) by 153 days.

(21) Appl. No.: 10/382,165

(22) Filed: Mar. 4, 2003

(65) Prior Publication Data

US 2004/0181849 A1 Sep. 23, 2004

(51) Int. Cl.
*A42B 1/00* (2006.01)

(52) U.S. Cl. ..... 2/200.3

(58) Field of Classification Search ..... 2/195.1, 2/195.2, 200.1, 200.3, 175.1; 223/7–12
See application file for complete search history.

(56) References Cited

U.S. PATENT DOCUMENTS

| | | | | | |
|---|---|---|---|---|---|
| 1,250,968 | A | | 12/1917 | Claussen | |
| 2,083,000 | A | | 6/1937 | Bennard | |
| 2,136,473 | A | * | 11/1938 | Sloan et al. | 2/410 |
| 2,136,827 | A | * | 11/1938 | Schur | 2/195.1 |
| 2,416,062 | A | | 2/1947 | Mercer | |
| 3,631,539 | A | * | 1/1972 | Massa | 2/418 |
| 3,922,424 | A | | 11/1975 | Anderson | |
| RE29,452 | E | | 10/1977 | Townsend, Jr. | |
| 4,244,058 | A | | 1/1981 | Randall | |
| 4,286,338 | A | | 9/1981 | Maney | |
| 4,429,420 | A | | 2/1984 | Wolff | |
| 4,476,589 | A | | 10/1984 | Burgin et al. | |
| 4,837,865 | A | | 6/1989 | Roth | |
| 5,025,504 | A | | 6/1991 | Benston et al. | |
| 5,054,123 | A | | 10/1991 | Helms | |
| 5,094,343 | A | | 3/1992 | Brown et al. | |
| 5,154,968 | A | | 10/1992 | DePetris et al. | |
| 5,247,709 | A | | 9/1993 | Epply | |
| 5,268,222 | A | | 12/1993 | Honeycutt | |
| 5,356,518 | A | * | 10/1994 | Kelley et al. | 162/224 |
| 5,431,784 | A | | 7/1995 | Miyamoto et al. | |
| 5,531,864 | A | | 7/1996 | Miyamoto et al. | |
| 5,553,327 | A | | 9/1996 | Koecher et al. | |
| 5,656,135 | A | | 8/1997 | Baker | |
| 5,679,433 | A | | 10/1997 | Hayashi et al. | |
| 5,685,756 | A | | 11/1997 | Noda | |
| D390,689 | S | | 2/1998 | Ochiai | |
| 5,785,817 | A | | 7/1998 | Tan et al. | |
| 5,833,796 | A | | 11/1998 | Matich | |
| 6,035,446 | A | | 3/2000 | Johnson | |
| 6,048,440 | A | | 4/2000 | Baker | |
| 6,277,422 | B1 | | 8/2001 | Gale | |
| 6,287,428 | B1 | | 9/2001 | Gale et al. | |
| 6,295,649 | B1 | | 10/2001 | Kang | |
| 6,364,151 | B1 | | 4/2002 | Gale | |
| 6,461,480 | B1 | * | 10/2002 | Otakura et al. | 162/220 |

OTHER PUBLICATIONS

Southern Pulp Machinery (PTY) Ltd; http://www.pulptech-.com/contact.htm; 918/2002; 7 pages.

(Continued)

*Primary Examiner*—Katherine M. Moran
(74) *Attorney, Agent, or Firm*—Schwabe, Williamson & Wyatt, P.C.

(57) ABSTRACT

The present invention includes a hat having a dome portion that substantially matches a person's head and a bill portion that is integrated with the dome portion. The dome portion and the bill portion are formed from a slurry of fibrous pulp material and has a substantially rigid structure.

7 Claims, 4 Drawing Sheets

OTHER PUBLICATIONS

Emery International Developments Ltd; The Pulp Moulding Process; http://www.emeryinternational.com/processes/processintro.html; Jan. 16, 2003; 3 pages.
Emery International Developments Ltd; Choosing a Machine; http://www.emeryinternational.com/machines/choosemachine.html; Jan. 16, 2003; 2 pages.
Impepa; The Four Basic Types of Molded Pulp; http://www.impepa.com/4types.htm; 1998-2000; 2 pages.
Southern Pulp Machinery (PTY) Ltd; Southern Pulp Machinery Products; file://C:DOCUME-1\RickH\LOCALS-1\Temp\triGAGFH.htm; Jan. 16, 2003; 2 pages.
Molded Fiber: when protection is important; http://www.huhtamaki.com/apps/web/WebContentMgr.nsf/A7568D4FB546A2A5C2256B...; Sep. 18, 2002; 1 page.
PX Series; High Tech Systems for Superb Product Quality; http://www.pxtech.com/new__page__2.htm; Jan. 16, 2003; 2 pages.
2003 R&D: Benefits of Thermal Drying; 1 page.
Regale; Repackaging the World; http://www.regale.com/directions/repack/html; Jun. 14, 2002; 17 pages.
Impepa; Why Use Molded Pulp Packaging?; http://www.impepa.com/whyuse.htm; 1998-2000; 2 pages.

* cited by examiner

MOLDED FIBROUS PULP HAT

FIELD OF INVENTION

The present invention relates generally to hats formed of fibrous material and more particularly, it relates to a hat molded from fibrous pulp.

BACKGROUND OF THE INVENTION

Commonly, at various gatherings of people, hats are provided as a promotional mechanism for an organization. For example, at a trade show, a business may hand out promotional hats with the business's logo, thereby facilitating advertising for the business. Additionally, at various outdoor activities, the promotional hats with the business's logo further provide a form of protection from the elements such as weather. Accordingly, it is advantageous for the business to hand out hats and for the people to receive the hats. However, there are various disadvantages associated with promotional type hats.

One disadvantage is the cost associated with producing the hats because the number of people may be numerous. In order to ensure that the hats are relatively inexpensive, the hats may be commonly made of inexpensive materials, such as, paper. However, hats made of paper are commonly thin, structurally weak, may require some assembly, and may have an appearance that is not representative of hats (i.e., not aesthetically pleasing). Accordingly, often times, the hats made of paper may not be reusable and end up being discarded even before the end of the gathering resulting in an undesirably short advertising effect.

Thus, a need exists for a hat that overcomes at least some of the above disadvantages.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION OF THE INVENTION

In the following description, various aspects of the present invention will be described. However, it will be apparent to those skilled in the art that the present invention may be practiced with only some or all aspects of the present invention. For purposes of explanation, specific numbers, materials and configurations are set forth in order to provide a thorough understanding of the present invention. However, it will also be apparent to one skilled in the art that the present invention may be practiced without the specific details. In other instances, well known features are omitted or simplified in order not to obscure the present invention.

Reference throughout this specification to "one embodiment" or "an embodiment" means that a particular feature, structure, or characteristic described in connection with the embodiment is included in at least one embodiment of the invention. Thus, the appearances of the phrases "in one embodiment" or "in an embodiment" in various places throughout this specification are not necessarily all referring to the same embodiment or invention. Furthermore, the particular features, structures, or characteristics may be combined in any suitable manner in one or more embodiments.

In various embodiments of the invention, a hat formed from fibrous pulp material, is described. This and other advantages will be evident from the disclosure.

Figure 1:
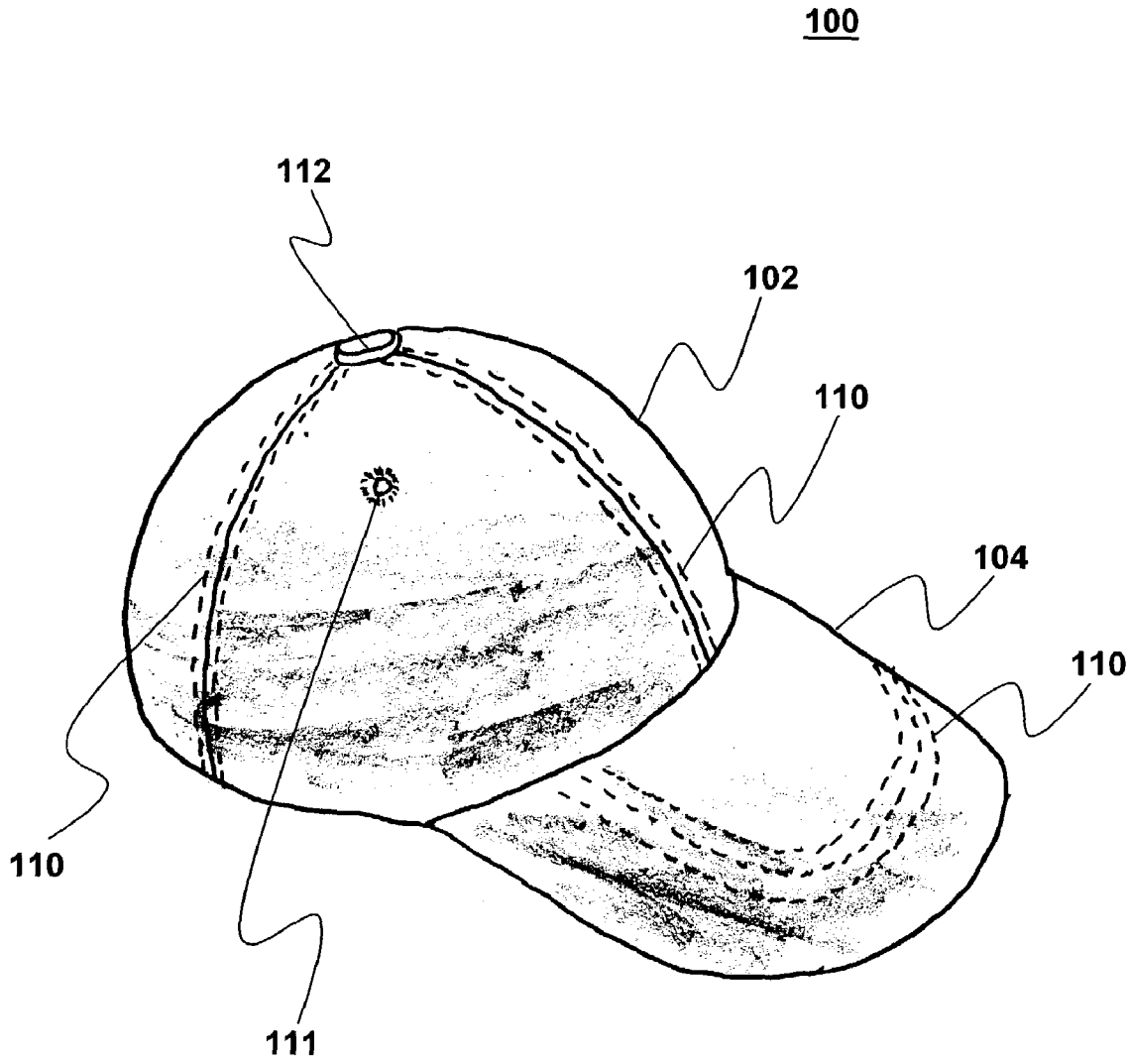
FIG. 1 illustrates a perspective view of a hat formed from a fibrous pulp material, in accordance with one embodiment of the present invention.

FIG. 1 illustrates a perspective view of a hat formed from a fibrous pulp material, in accordance with one embodiment of the present invention. Illustrated in FIG. 1, a hat 100 includes a dome portion 102 and a bill portion 104. The dome portion 102 and the bill portion 104 may be integrated to form the hat 100 as shown.

For the purposes of illustrating an embodiment of the present invention, the hat 100 has a shape that may be representative of a baseball style hat. However, it should be appreciated by those skilled in the art that the hat 100 formed of a fibrous pulp material may have a shape representative of any type of hat such as, but not limited to, a western style hat, a fedora style hat, open crown style hats, etc. Accordingly, the dome 102 and bill 104 portions may be configured to correspond to various styles of hats.

Additionally, in the illustrated embodiment of FIG. 1, dome 102 and bill portions 104 include various features 110–112 such as, but not limited to, features representative of stitching 110, features representative of ventilation holes 111, and features representative of a button 112. Together, the features 110–112 visually add to the shape of the hat 100. That is, the combination of the dome portion 102, the bill portion 104, and the features 110–112 results in a hat having the appearance of a typical baseball style hat. Alternatively, in various embodiments, the hat 100 may include features that may result in a hat having an appearance of various other types of hats such as a western style hat as previously described. Alternatively, in various embodiments, the hat 100 may not include various features 110–112, in order to provide a smooth continuous surface on the hat 100.

As alluded to previously, in various embodiments, the dome 102 and bill portions 104 may also include features representative of various logos of organizations. That is, the hat 100 may be utilized to facilitate advertising for organizations such as businesses. For example, business logos may be placed on various surfaces of the hat 100. Additionally, the hat 100 may function as a typical hat by providing a form of protection from various environmental elements such as, but not limited to, the sun. As will be described in further detail, the hat 100 is formed from a fibrous pulp material 404 (shown in FIG. 4), in accordance with the teachings of the present invention.

The fibrous pulp material 404 advantageously provides a relatively inexpensive material that is structurally strong resulting in long lasting reusability. Moreover, the fibrous pulp material 404 may be configured to be substantially representative of various types of hats (i.e., aesthetically pleasing). Additionally, the fibrous pulp material 404 may be readily recyclable, biodegradable, compostable, and so forth.

As a result, a hat may be advantageously formed from fibrous pulp material and be in the shape of various types of hats.

Figure 2A:
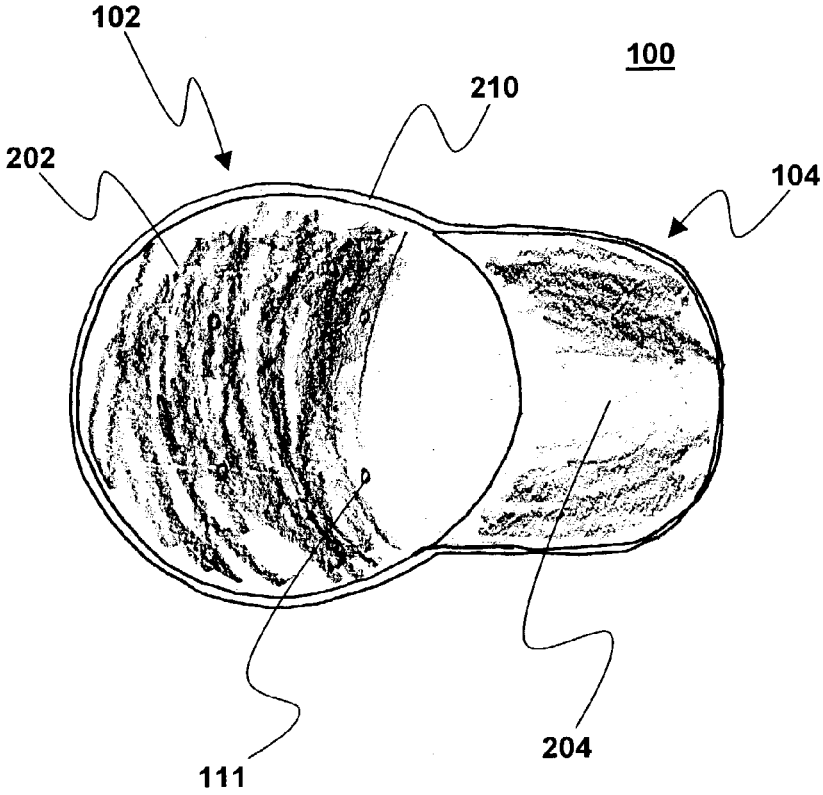
FIGS. 2A–2C illustrate various views of a hat formed from a fibrous pulp material, in accordance with one embodiment of the present invention.
Figure 2B:
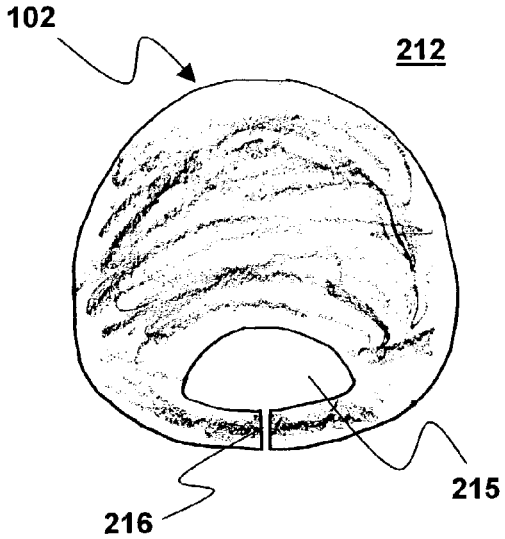
Figure 2C:
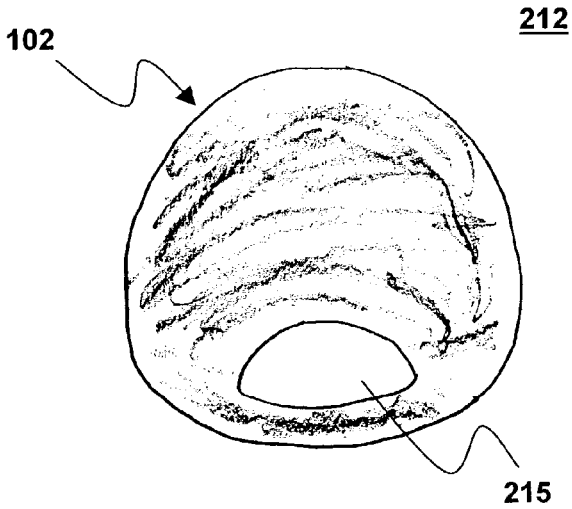

FIGS. 2A–2C illustrate various views of a hat formed from a fibrous pulp material, in accordance with one embodiment of the present invention. Illustrated in FIG. 2A is a bottom view of the hat 100 showing an inside of the dome portion 202 and an underside of the bill portion 204. Additionally, in the illustrated embodiment of FIG. 2A, the inside of the dome portion 202 includes features representative of ventilation holes 111 (shown in FIG. 1). Note that the inside of the dome portion 202 does not include features representative of stitching 110 because as previously alluded to, the hat 100 formed from fibrous pulp material 404 do not require actual stitching.

Because the hat 100 is formed from fibrous pulp material 404, a wall thickness 210 of the hat 100 is shown. The wall thickness 210 illustrates thickness of the material forming the hat 100, in particular, fibrous pulp material 404. As shown, the wall thickness 210 may be substantially uniform for the entire hat 100 and be sufficient to provide a rigid structure for the hat 100. For example, in one embodiment, the wall thickness 210 may have a dimensional range of 0.040–0.187 inches.

The inside of the dome portion 202 may be configured to accommodate an average person's head (not shown). For example, in one embodiment, the inside of the dome portion 202 may have a depth of approximately 4 inches and a diameter of approximately 7 inches. Additionally, underside of the bill portion 204 may be configured to provide some form of protection from environmental elements such as, but not limited to, shade to the person's head. The bill portion 204 may have example dimensions of approximately 3.5 inches in length and approximately 5.5 inches in width.

Shown in FIG. 2B is a back of the dome portion 212 having a back feature 215, in accordance with one embodiment. In the illustrated embodiment, the back feature 215 may be configured to facilitate size adjustment of the hat (i.e., expansion of the dome portion by including an integrated expansion feature 216). In FIG. 2B, the integrated expansion feature 216 is shown as a gap that facilitates expansion and contraction to accommodate various sizes of heads. Alternatively, the expansion feature 216 may be any type of known expansion feature such as, but not limited to, an elastic type structure, a feature utilizing Velcro, a buckle type feature, and so forth.

Referring now to FIG. 2C, alternatively, in one embodiment, the back feature 215 may be a hole type feature that may facilitate wearing of the hat 100 with a "pony tail". That is, the back feature 215 provides a hole, through which, hair tied in a lengthwise fashion may pass through. Additionally, the back feature 215 may facilitate airflow through the hat 100, thereby ventilating the person's head. Alternatively, in various embodiments, the back of the dome portion 212 may not include the back feature 215, thereby providing a smooth continuous surface.

As previously described, the hole feature may also be based at least in part on the style of hat. For example, for a western style hat, the hole feature may not be present, while an integrated expansion feature may be included in the dome portion and/or the bill portion of the western style hat to facilitate accommodation of various head sizes.

As a result, a person having various head sizes may advantageously wear a hat formed from fibrous pulp material. Further, the hat formed from fibrous pulp material may be worn by persons having a variety of hairstyles and comfort needs.

Figure 3A:
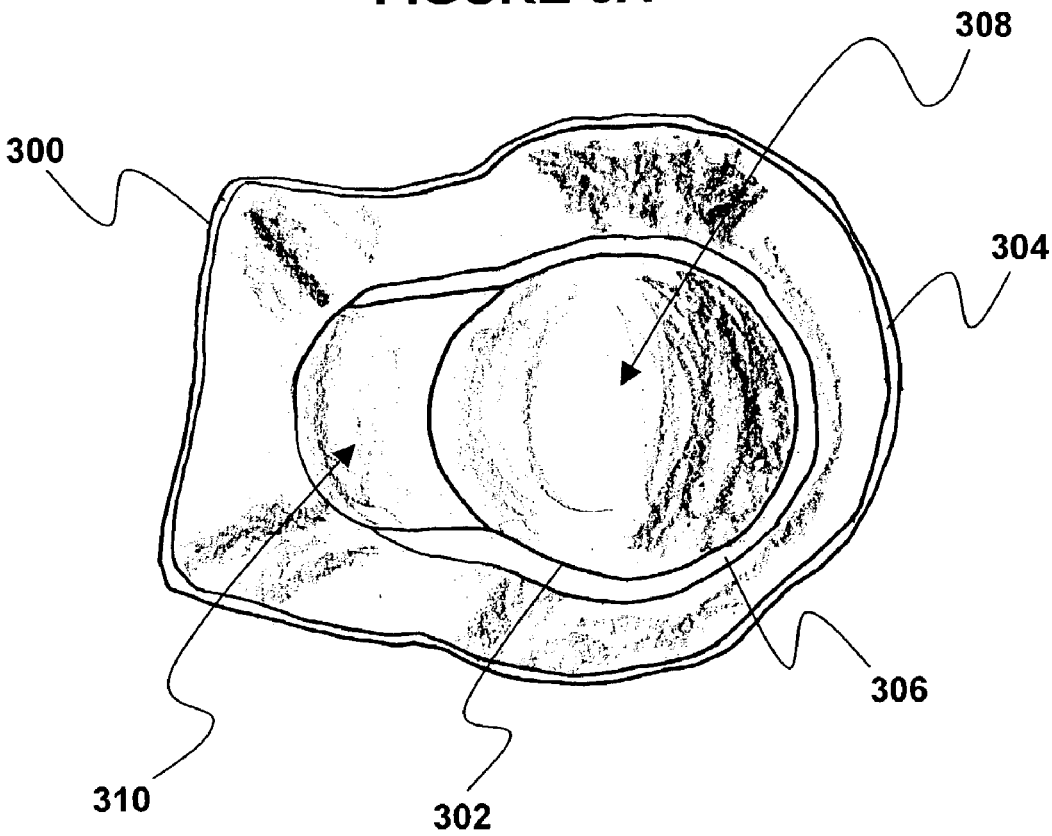
FIGS. 3A–B illustrate a mold from which a hat may be formed, in accordance with one embodiment.
Figure 3B:
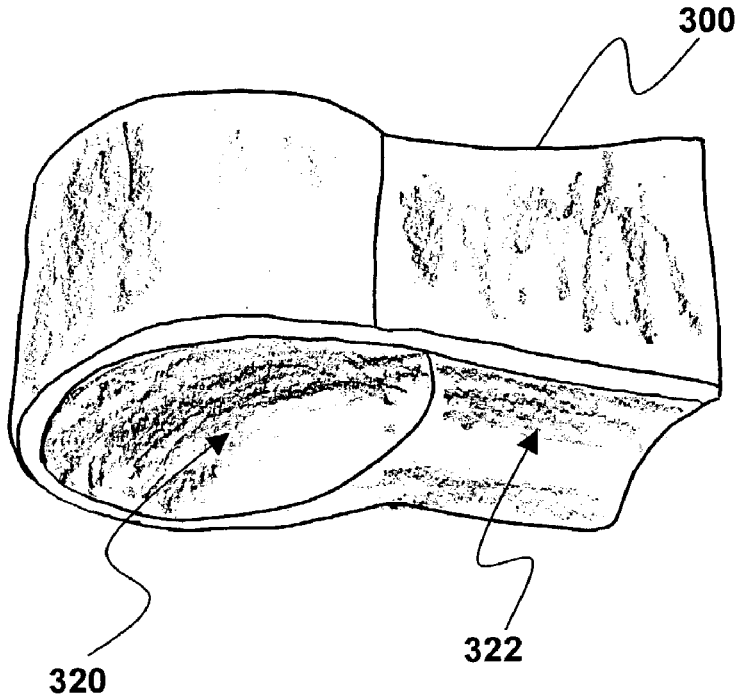

FIGS. 3A–B illustrate a molded fibrous product from which a hat may be formed, in accordance with one embodiment. Illustrated in FIG. 3A is a top view of a molded fibrous product 300 having a hat feature 302. The molded fibrous product 300 has a thickness 304 and an outline 306 surrounding the hat feature 302. In the embodiment of FIG. 3A, the hat feature 302 includes a dome portion 308 and a bill portion 310. The molded fibrous product 300, the hat feature 302 having the dome portion 308 and the bill portion 310, and the outline of the hat 306 are all integrated as the single molded fibrous product 300 having the thickness 304.

Figure 4:
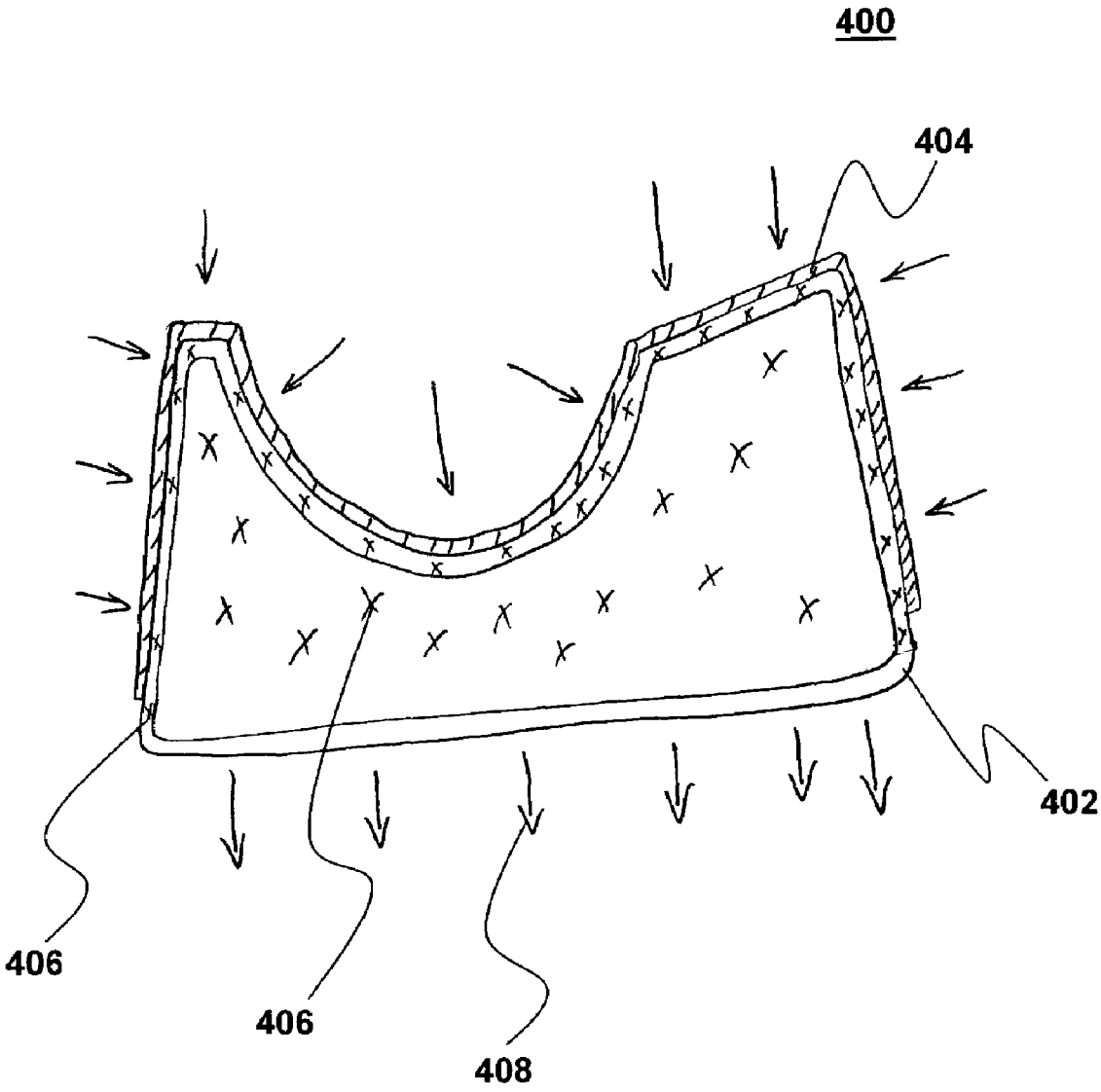
FIG. 4 illustrates a manner of forming a hat from a fibrous pulp material, in accordance with one embodiment of the present invention.

In accordance with the teachings of the various embodiments, the molded fibrous product 300 may be formed from the fibrous pulp material 404 (shown in FIG. 4). Additionally, as previously described, the thickness 304 may be of the substantially uniform wall thickness 210 (shown in FIG. 2) for the hat 100 (shown in FIG. 1) to provide a rigid structure to the hat 100.

Continuing to refer to FIG. 3A, the hat feature 302 may be removed from the molded fibrous product 300 resulting in a hat such as the hat 100 of FIG. 1. That is, the molded fibrous product 300 facilitates forming of the hat feature 302, and once the molded fibrous product 300 is formed having the hat feature 302, the hat feature 302 may be separated from the molded fibrous product 300 resulting in the hat 100.

Turning now to FIG. 3B, a bottom view of the molded fibrous product 300 illustrates an inside of the dome portion 320 and an underside of the bill portion 322. Accordingly, the inside of the dome portion 320 and the underside of the bill portion 322 of the hat feature 302 may be substantially similar to the inside of the dome portion 202 and an underside of the bill portion 204, both shown in FIG. 2. That is, a person may advantageously wear the hat resulting from the separation of the hat feature 302 from the molded fibrous product 300. Alternatively, the molded fibrous product 300 may itself be worn by the person.

FIG. 4 illustrates a manner of forming a hat from a fibrous pulp material, in accordance with one embodiment of the present invention. Illustrated in FIG. 4 is a cross-sectional view 400 of a mold form 402 configured to achieve the desired shape of FIGS. 1–3B. The mold form 402 may be porous to facilitate coating of the mold form 402 with fibrous material 404.

In one embodiment, the mold form 402 may be covered by a porous structure having perforations 406, where the porous structure has the shape of a hat such as, but not limited to, a baseball style hat type. Additionally, as previously alluded to, the porous structure may have features corresponding to the style of hat such as, but not limited to, features representative of stitching, ventilation holes, a button, business logos, and the like. In various embodiments, the mold form 404 may be a porous metallic structure, porous plastic structure, porous ceramic structure, or the like.

In whatever type or kind, the mold form 402 may be mounted on a machine (not shown) and the machine submerges the mold form 402 into a receptacle holding a slurry of fibrous pulp material 404 (i.e., a vat of fibrous pulp material suspended in a liquid). In one embodiment, the fibrous pulp material 404 may be fibrous paper pulp type material such as, but not limited to, recycled paper, recycled newspaper, cardboard, and the like, and may also include various coloring materials. In particular, fibrous pulp material that is capable of recycling, bio-degrading, and providing a rigid structure to the hat 100 (shown in FIG. 1).

Continuing to refer to FIG. 4, the mold form 402 is subjected to a vacuum 408, as illustrated by directional arrows. The vacuum 408 facilitates coating of the mold form 402 with the slurry of fibrous pulp material 404. Accordingly, the slurry of fibrous pulp material 404 may be vacuum 408 drawn onto the mold form 402 as shown. The liquid passes through the mold form 402 as permitted by perforations 406, and the fibrous pulp material 404 builds up on the outside surface of the mold form 402 (i.e., molding surface). As the fibrous pulp material 404 builds, the resistance to liquid flow through the walls of the mold form 402 increase, thereby inducing a relatively even distribution of the fibrous pulp material 404 on the mold form 402. That is, the greater the build up, the greater the resistance to flow and thus the thickness of the fibrous material 404 onto the mold form 402 may be maintained substantially uniform. In a relatively short period of time, the molded fibrous product 300 (shown in FIG. 3A–B) is fully formed on the forming surface of the mold form 402 and has a uniform deposit of fibrous pulp material 404 through out, commonly referred to as a "mat". As previously described, the mat may have a uniform thickness to provide a rigid structure.

In its crudest form, the molded fibrous product 300 is formed in a single mold form (either male or female). However, better control of the external dimensional tolerances, and improvements in protective property of the device can be obtained if the newly formed mat is first compressed in a matting (commonly male or female type) compression (or transfer) mold. The mold form 402 may then be removed out of the vat and transferred to a transfer device (transfer mold) which deposits the newly molded fibrous product 300 having the hat feature 302 (shown in FIG. 3A–B) onto a conveyor.

In one embodiment, once the mold form 402 is removed out of the vat, the fibrous pulp material 404 is separated from the mesh structure. That is, the molded fibrous product 300 in the shape of the mold form 402 is separated from the mold form 402 and deposited onto a conveyor.

In one embodiment, the separation may be achieved by providing pressurized gas to the mold form 402 in the opposite direction of the vacuum 408. Once separated, the fibrous pulp material may be allowed to cure resulting in a substantially rigid structure. It should be appreciated by those skilled in the art that curing may refer to any type of process by which solidification of the molded fibrous product 300 is facilitated such as drying.

Alternatively, in one embodiment, the mold form 402 having the molded fibrous product 300 may be cured without separation, and once separated, the molded fibrous product 300 may be separated from the mold form 402 by compressed air as previously described. Alternatively, the molded fibrous product 300 may be separated by various mechanical means as well.

As previously alluded to, the fibrous pulp material may be of any type of fibrous material that may be utilized in a slurry form such as, but not limited to, fibrous pulp type material. Preferably, the fibrous pulp material is recyclable and provides a rigid structure to the end product. In particular, the fibrous pulp material may be recyclable through common recycling means, and may also be bio-degradable by various means such as, but not limited to, consumption by microorganisms.

Furthermore, the separation of the fibrous pulp material, in particular, the molded fibrous product 300 from the mold form 402 is further facilitated by the mold form 402 having "pattern-like" features such as, but not limited to, absence of negative angles. That is, the mold form 402 is configured to facilitate removal of molded fibrous product 300 intact without having areas of conflicting geometry or non-releasable surfaces between the mold form 402 and the molded fibrous product 300.

The mold form 402 may also be configured in such a manner as to include the various features representative of various hat styles. Additionally, various printing may be placed on the surfaces of the hat 100, thereby facilitating promotional type hats (i.e., hat with logos of businesses). Further, the hat 100 may provide protection and comfort from various environmental elements.

Alternatively, the mold form 402 may be configured to provide a relatively smooth surface over the entire hat 100. Various designs and text (i.e., logos) may be placed on its surface in a subsequent operation, after the molded fibrous product 300 or the hat 100 is formed. For example, the hat 100 may receive application of various colorings and coatings. In addition to the placement of various designs and text, the subsequent operation may also involve adding various features such as, but not limited to, the previously described features. That is, the relatively smooth surface of the dome portion 102 and bill portion 104 may be configured to receive various features, designs, and text in a secondary operation e.g., post pressing type operation such as, but not limited to direct pressing operations.

Those skilled in the art will recognize that modifications and variations may be made without departing from the true spirit and scope of the invention. The invention is therefore not to be limited to the embodiments described and illustrated.

Thus, a hat formed from fibrous pulp material, has been described.

What is claimed is:

1. A method of producing a hat intended for temporary use comprising:

coating a porous structure with a slurry of fibrous pulp-material, the porous structure having a shape of the hat and the fibrous pulp material including a property of readily biodegrading;

separating the fibrous pulp material from the porous structure, the separated fibrous pulp material having the shape of the porous structure;

curing the separated fibrous pulp material, the cured separated fibrous pulp material forming a substantially rigid structure and having the shape of the hat and said hat including said property of readily biodegrading; and applying indicia and treatment to the hat as desired to render use of the hat as a promotional item without dilution of said property of readily biodegrading.

2. The method of claim 1 wherein coating the porous structure comprises coating a porous structure having a shape substantially matching a shape of a baseball style hat.

3. The method of claim 2, wherein coating the porous structure further comprises coating a porous structure having various features representative of the style of hat, the features being at least one of stitching, ventilation holes, and a button and being based at least in part on the style of hat.

4. The method of claim 1 further comprising providing various features representative of a style of hat, the various features being at least one of stitching, ventilation holes, and a button and being based at least in part on the style of hat.

5. The method of claim 1 further comprising providing at least one of a design and logo, the design and logo configured to provide advertisement of an organization.

6. The method of claim 1, wherein coating the porous structure comprises immersing a porous structure into a receptacle holding the slurry of fibrous pulp material.

7. The method of claim 1, wherein coating the porous structure comprises vacuum drawing a slurry of fibrous pulp material onto the porous structure.

* * * * *